US005415387A

United States Patent [19]

Suzuki

[11] Patent Number: 5,415,387

[45] Date of Patent: May 16, 1995

[54] SHEET FEED DEVICE FOR A SELECTABLE PRINT SPEED IMAGE FORMING DEVICE HAVING A TIME DELAYED PICK-UP ROLLER

[75] Inventor: Kazuyuki Suzuki, Natori, Japan

[73] Assignee: Ricoh Company, Ltd., Tokyo, Japan

[21] Appl. No.: 329,427

[22] Filed: Oct. 24, 1994

Related U.S. Application Data

[63] Continuation of Ser. No. 54,131, Apr. 30, 1993, abandoned.

[30] Foreign Application Priority Data

Apr. 30, 1992 [JP] Japan ..... 4-111515

[51] Int. Cl.[6] ..... B65H 5/00; B65H 5/34

[52] U.S. Cl. ..... 271/10; 271/114; 271/227; 271/242; 271/265; 271/270

[58] Field of Search ..... 271/10, 114, 227, 242, 271/265, 270, 272, 275

[56] References Cited

FOREIGN PATENT DOCUMENTS 124447 6/1986 Japan ..... 271/10

282138 11/1990 Japan ..... 271/270

88659 4/1991 Japan ..... 271/242

684340 12/1952 United Kingdom .

2234961 2/1991 United Kingdom .

*Primary Examiner*—Cheryl L. Gastineau

*Assistant Examiner*—Boris Milef

*Attorney, Agent, or Firm*—Oblon, Spivak, McClelland, Maier & Neustadt

[57] ABSTRACT

In a sheet feed device for image forming equipment, a sheet feed section and a register section are each provided an exclusive drive arrangement. The sheet feed section starts feeding a sheet toward the register section in response to a feed start signal generated in an image forming section. The time for causing the sheet feed section to stop feeding a sheet or the time for causing the register section to start driving the sheet is delayed in matching relation to a print speed. As a result, the sheet feed section provides a sheet with a sufficient slack while the register section brings the sheet into accurate register with an image and can change the position of an image on the sheet in the top-and-bottom direction.

2 Claims, 14 Drawing Sheets

FIG. 12

| PRINT SPEED / DIS-PLACE-MENT | a (m/sec) | b (m/sec) | c (m/sec) | d (m/sec) |
|---|---|---|---|---|
| -15 (mm) | 0 | 0 | 0 | 0 |
| -14 | 4.1 | 1.8 | 1.2 | 1.0 |
| -13 | 8.3 | 3.5 | 2.5 | 1.9 |
| -12 | 12.4 | 5.3 | 3.7 | 2.9 |
| -11 | 16.5 | 7.1 | 5.0 | 3.8 |
| -10 | 20.7 | 8.9 | 6.2 | 4.8 |
| -9 | 24.8 | 10.6 | 7.4 | 5.7 |
| -8 | 28.9 | 12.4 | 8.7 | 6.7 |
| -7 | 33.1 | 14.2 | 9.9 | 7.6 |
| -6 | 37.2 | 15.9 | 11.2 | 8.6 |
| -5 | 41.3 | 17.8 | 12.4 | 9.6 |
| -4 | 45.5 | 19.5 | 13.6 | 10.5 |
| -3 | 49.6 | 21.3 | 14.9 | 11.5 |
| -2 | 53.7 | 23.0 | 16.1 | 12.4 |
| -1 | 57.9 | 24.8 | 17.4 | 13.4 |
| 0 | 62.0 | 26.6 | 18.6 | 14.3 |
| +1 | 66.1 | 28.3 | 19.8 | 15.3 |
| +2 | 70.3 | 30.1 | 21.1 | 16.2 |
| +3 | 74.4 | 31.9 | 23.3 | 17.2 |
| +4 | 78.5 | 33.7 | 23.6 | 18.1 |
| +5 | 82.7 | 35.4 | 24.8 | 19.1 |
| +6 | 86.8 | 37.2 | 26.0 | 20.1 |
| +7 | 91.0 | 39.0 | 27.3 | 21.0 |
| +8 | 95.1 | 40.7 | 28.5 | 22.0 |
| +9 | 99.2 | 42.5 | 29.8 | 22.9 |
| +10 | 103.3 | 44.3 | 31.0 | 23.9 |
| +11 | 107.5 | 46.1 | 32.2 | 24.2 |
| +12 | 111.6 | 47.2 | 33.5 | 35.8 |
| +13 | 115.7 | 49.6 | 34.7 | 26.7 |
| +14 | 119.9 | 51.4 | 35.9 | 27.7 |
| +15 | 124.0 | 53.1 | 37.2 | 28.7 |

SHEET FEED DEVICE FOR A SELECTABLE PRINT SPEED IMAGE FORMING DEVICE HAVING A TIME DELAYED PICK-UP ROLLER

This application is a Continuation of application Ser. No. 08/054,131, filed on Apr. 30, 1993, now abandoned.

BACKGROUND OF THE INVENTION

The present invention relates to a sheet feed device for a printer, copier or similar image forming equipment.

It is a common practice with a sheet feed device of image forming equipment to feed a stack of sheets one by one from a rack or table toward a pair of register rollers movable into and out of contact with each other. The register rollers drive the sheet to an image forming section where an ink drum or a photoconductive element, for example, is located. In this type of sheet feed device, a pick-up roller associated with the rack is rotated in such an amount that the sheet moves a distance greater than the distance between the pickup roller and the register roller pair. Hence, after the leading edge of the sheet has abutted against the register roller pair, the leading edge portion of the sheet is sequentially slackened until the pick-up roller stops rotating. This allows the register roller pair to start driving the sheet at an accurate time and corrects the skew of the sheet which may occur during transport, despite the difference between the coefficient of friction of the sheet and that of the pick-up roller and the irregularity in the transport resistance of the path. The sheet feed device may be provided with a drive source implemented by a motor which drives the ink drum or the photoconductive element, a speed changing mechanism in the form of a gear train interlocked with the drive source, a cam for bringing the register roller pair into and out of contact, and a drive transmission mechanism for the cam.

The sheet feed device of the type described has various problems left unsolved, as follows. To begin with, the structure for driving the pick-up roller and register roller needs a great number of parts and is not easy to design due to complexity. Although such parts may be accurately assembled as designed, it is likely that the interlocked relation is disturbed due to their mechanical wear and fatigue as the device is repetitively operated. Then, even when the pick-up roller is rotated a predetermined amount, the actual displacement of the sheet becomes short and prevents the sheet abutting against the register roller pair from being sufficiently slackened. If the abutment of the sheet against the register roller pair which is based on the slack or elasticity of the sheet is not sufficient, the register roller pair is apt to start feeding the sheet at an unexpected time or to fail to correct the skew of the sheet. This brings the sheet out of register with an image provided on the ink drum or the photoconductive element. The misregister of the sheet and image is particularly serious when the print speed or the copy speed is changed.

Another function available with the register roller pair is to change the position on the sheet where an image begins to be transferred in a range corresponding to the upstream side with respect to a sheet feed direction, i.e., in the top-and-bottom direction. With this function, it is possible to change the area of a blank portion or margin to be formed at opposite ends of the sheet with respect to the sheet feed direction. This can be done if the time when the register roller pair starts feeding the sheet is changed. However, the register roller having such a function has to be provided with a number of constituents for transmitting a drive force from the drive source associated with the ink drum or the photoconductive element, as stated earlier. Moreover, the register roller needs a cam for changing the drive timing thereof, a drive source for operating the cam, an encoder or a sensor for determining the current displacement of an image in the top-and-bottom direction, noticeably scaling up and complicating the structure. In addition, since the interengagement of the constituent parts is apt to get out of order, the displacement of an image which can be set is limited to a certain range, resulting in low resolution. Therefore, to change the displacement, it is sometimes necessary to change the design itself.

SUMMARY OF THE INVENTION

It is therefore an object of the present invention to provide a sheet feed device for image forming equipment which has a simple construction made up of a minimum number of parts, reduces the influence of aging of constituent parts, and slackens a sheet stably.

It is another object of the present invention to provide a sheet feed device for image forming equipment which has a simple construction made up of a minimum number of parts, reduces the influence of aging of constituent parts, and feeds a sheet over a constant distance.

It is another object of the present invention to provide a sheet feed device for image forming apparatus which has a simple construction made up of a minimum number of parts, reduces the influence of aging of constituent parts to facilitate the change in the displacement of an image on a sheet, and allows the displacement to be set with free resolution.

In accordance with the present invention, in a sheet feed device for image forming equipment and having a rack on which sheets are stacked, a pick-up section for feeding uppermost one of the sheets from the rack while separating it from the others, and a register section located upstream of an image forming section with respect to an intended direction of sheet feed, the device feeding the sheet toward the register section in response to a feed start signal from the image forming section, there are provided a sheet sensor for sensing the sheet being fed from the rack toward the register section, speed selecting means for entering a period of time necessary for an image to be formed at the image forming section, and a controller connected at an input to the sheet sensor and speed selecting means and at an output to a driver included in the pick-up section for controlling, on receiving a signal from the sheet sensor, an amount of drive of the pickup section in matching relation to information entered on the speed selecting means.

Also, in accordance with the present invention, in a sheet feed device of the type described, there are provided speed selecting means for entering a period of time necessary for an image to be formed at the image forming section, and a controller connected at an input to the speed selecting means and at an output to a driver included in the register section for controlling, on receiving a feed start signal from the register section derived from the image forming section, an amount of drive of the register section in matching relation to information entered on the speed selecting means.

Further, in accordance with the present invention, in a sheet feed device for image forming equipment and having a rack on which sheets are stacked, a pick-up section for feeding uppermost one of the sheets from the rack while separating it from the others, and a register section located upstream of an image forming section with respect to an intended direction of sheet feed, the device feeding the sheet toward the register section in response to a feed start signal from the image forming section and feeding the sheet from the register section toward the image forming section in response to a feed start signal from the register section derived from the image forming section, there are provided a sheet sensor for sensing the sheet being fed from the rack toward the register means, speed selecting means for entering a period of time necessary for an image to be formed at the image forming section, a first control circuit connected at an input to the sheet sensor and speed selecting means and at an output to a driver included in the pick-up section and a driver included in the register section for controlling, on receiving a signal from the sheet sensor, an amount of drive of the pick-up section in matching relation to information entered on the speed selecting means, and a second control circuit connected at an input to the sheet sensor and speed selecting means and at an output to the driver included in the register section for controlling an amount of drive of the register section in response to a feed start signal from the register section derived from the image forming section.

BRIEF DESCRIPTION OF THE DRAWINGS

The above and other objects, features and advantages of the present invention will become more apparent from the following detailed description taken with the accompanying drawings in which:

FIG. 12 is a table listing specific displacements available with the control system of FIG. 11;

DESCRIPTION OF THE PREFERRED EMBODIMENTS

Figure 1:
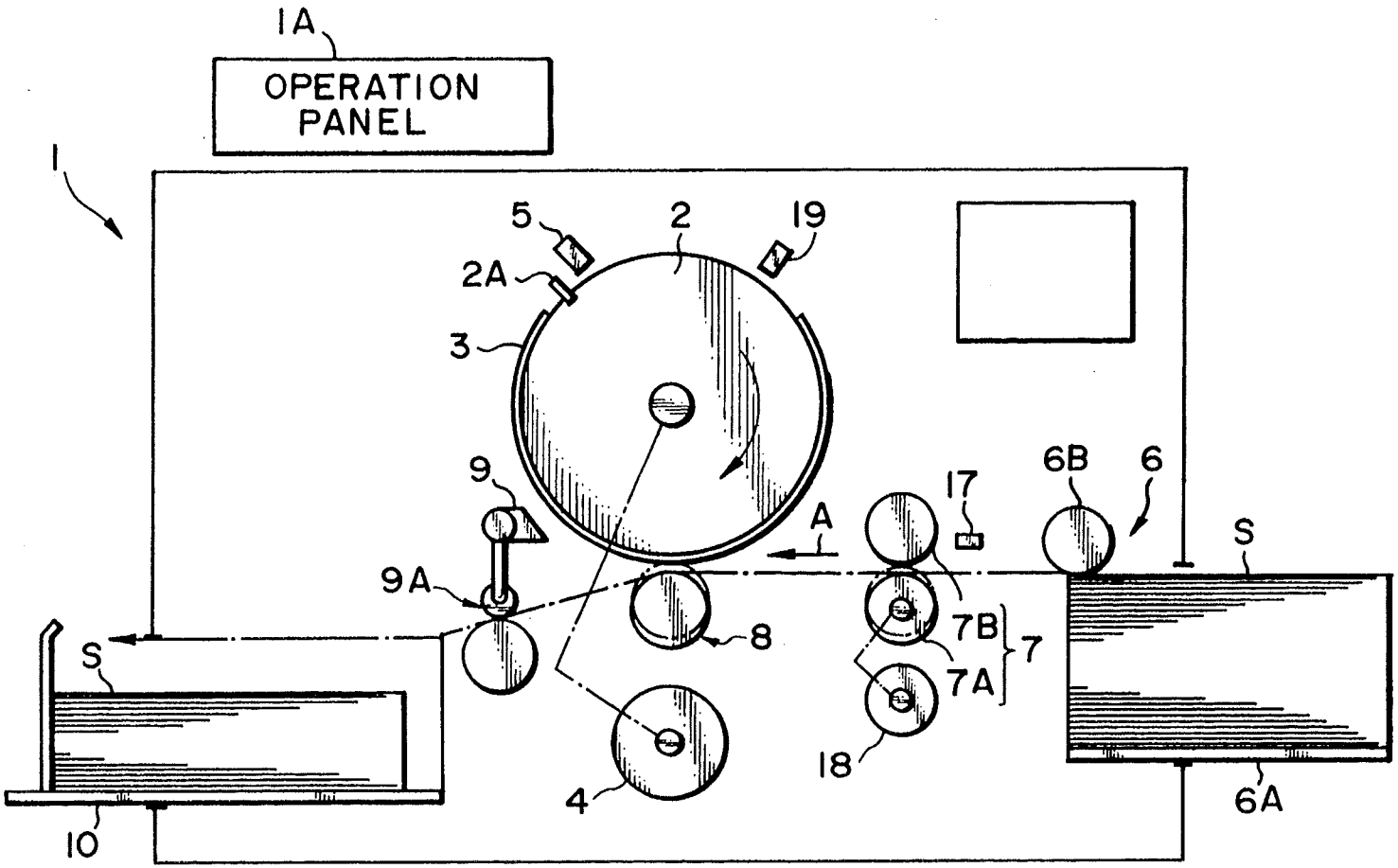
FIG. 1 shows the general construction of image forming equipment implemented as a printer and to which the present invention is applicable.

Referring to FIG. 1 of the drawings, image forming equipment to which a sheet feed device embodying the present invention is applied is shown. As shown, the equipment is implemented as a printer 1 having a hollow cylindrical ink drum 2. A cut stencil or master 3 is wrapped around the drum 2 by a clamp mechanisin, not shown. An ink supply mechanism, not shown, is disposed in the drum 2 to feed ink to the master 3. As a sheet is laid on the master 3, the ink is transferred to the sheet via the cuts of the master 3. The drum 2 is rotated by a drive motor 4 in a direction indicated by an arrow in the figure. An arrangement of causing a sheet to be picked up at a sheet feed section, which will be described, is associated with the drum 2. Specifically, a screen member 2A is affixed to the surface of the drum 2 while a pick-up roller trigger sensor 5 is disposed on the path which the screen member 2A moves. The pick-up roller trigger sensor 5 will be described later specifically in relation to a control system.

A sheet feed section 6, a register section 7 and a pressing section 8 are sequentially arranged from the upstream side to the downstream side, i.e., to a position preceding the drum 2 with respect to a sheet feed direction A, constituting an arrangement for feeding sheets to the drum 2. To discharge a sheet S to which an image has been transferred from the master 3, a separator 9, a roller pair 9A and a tray 10 are located downstream of the drum 2 in the sheet feed direction A. The separator 9 removes the sheet S from the master 3 of the drum 2. The sheet S removed by the separator 9 is transported by the roller pair 9A toward the tray 10.

Figure 2:
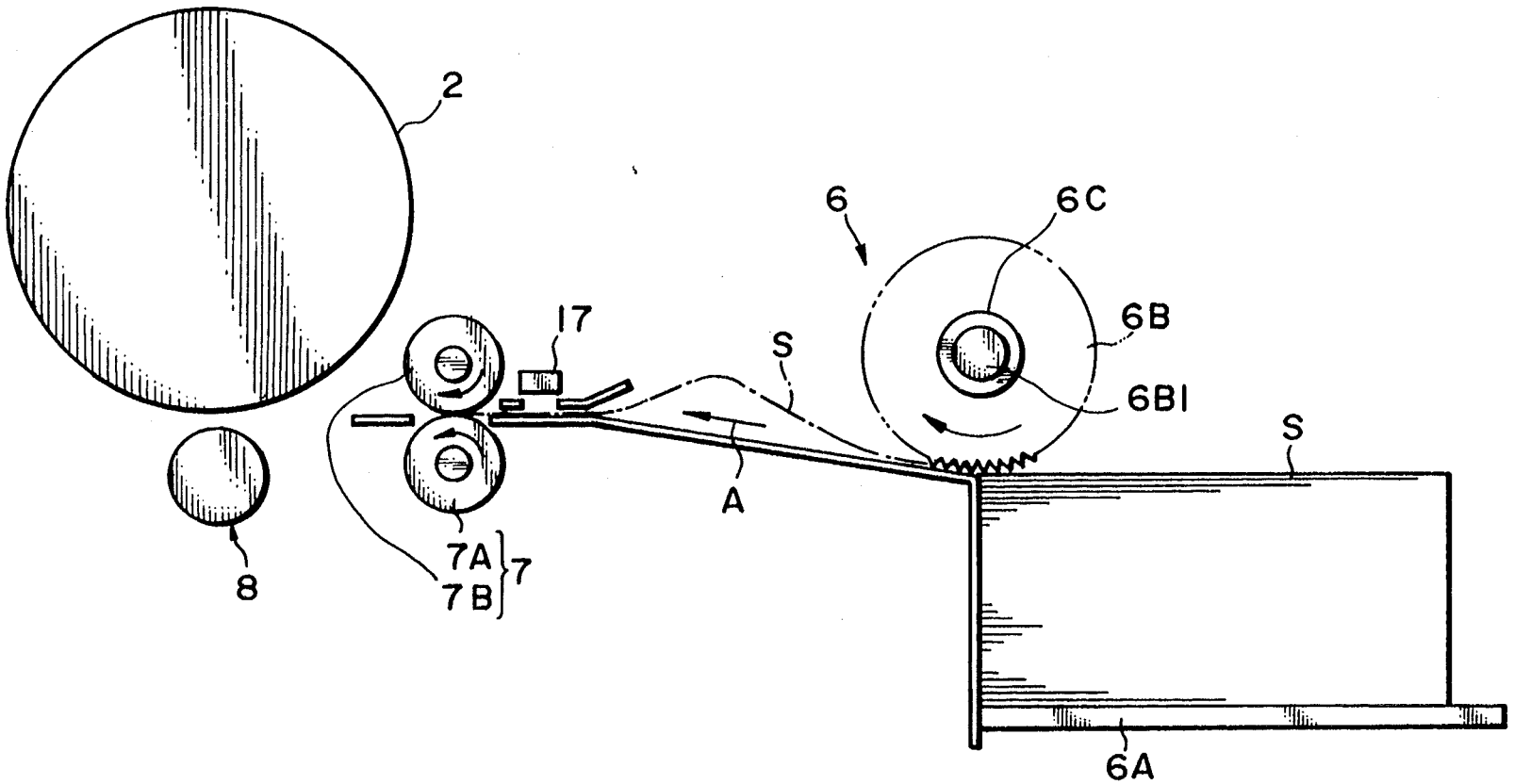
FIG. 2 is a view an essential part of a sheet feed device embodying the present invention.

The sheet feed section 6 has a rack 6A to be loaded with a stack of sheets S, and a pick-up roller 6B for feeding the uppermost sheet from the rack 6A while separating it from the others. As shown in FIG. 2, a one-way clutch 6C is mounted on a shaft 6B1 which supports the pick-up roller 6B, allowing the roller 6B to rotate only clockwise as viewed in the figure. On rotating clockwise, the pick-up roller 6B feeds the sheet S contacting the lower part of the roller 6B. A separating mechanism, not shown, separates the uppermost sheet S from the others on the basis of a difference in the coefficient of friction between the pick-up roller 6B and the sheets and a difference in the coefficient of friction between the wall of the rack 6A adjoining a sheet outlet and the sheets S.

Figure 3:
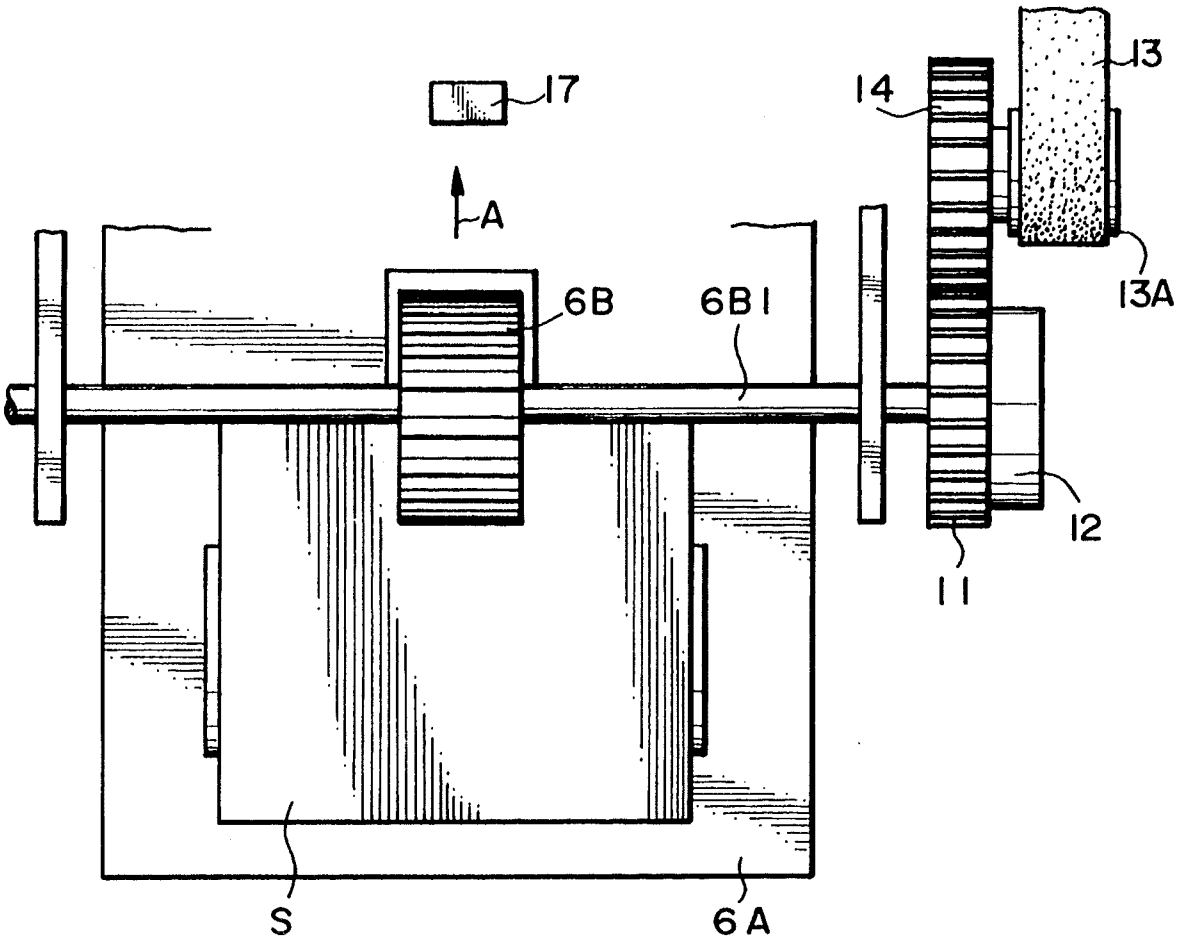
FIG. 3 is a fragmentary plan view of the embodiment.

The rotation of the drive motor 4, FIG. 1, is transmitted to the pick-up roller 6B. Specifically, as shown in FIG. 3, an electromagnetic clutch 12 is connected to the shaft 6B1 at the driven side thereof while a driven gear 11 is affixed to the drive side of the clutch 12. A belt 13 is passed over a belt pulley 13A and to which the rotation of the drive motor 4 is transmitted. A drive gear 14 is supported coaxially with the belt pulley 13A and held in mesh with the drive gear 11. The clutch 12 is usually held in a deenergized state. As the clutch 12 is energized, it couples the drive side and the driven side so as to rotate the shaft 6B1 via the drive gear 14 and driven gear 11. At this instant, the previously mentioned one-way clutch 6C regulates the direction of rotation of the shaft 6B1.

The register section 7 has a pair of register rollers 7A and 7B which respectively are disposed below and above a sheet transport path. In the illustrative embodiment, the rotation of the drive motor 4 is transferred to the lower register roller 7A to rotate it. Further, the drive force from the motor 4 causes the lower register roller 7A to periodically move into and out of contact with the upper register roller 7B via a moving mechanism, not shown. For example, a cam having a particular profile is included in the moving mechanism and causes the register roller 7A to contact the register roller 7B before the leading edge of the sheet S fed by the pick-up roller 6B reaches the register section 7. After the register roller 7A has been brought into contact with the register roller 7B, the rotation of the motor 4 is transmitted to the roller 7A. Then, the register roller 7B is rotated by the underlying register roller 7A. The register rollers 7A and 7B are rotated in particular directions to drive the sheet S in the direction A at their contact position.

Figure 4:
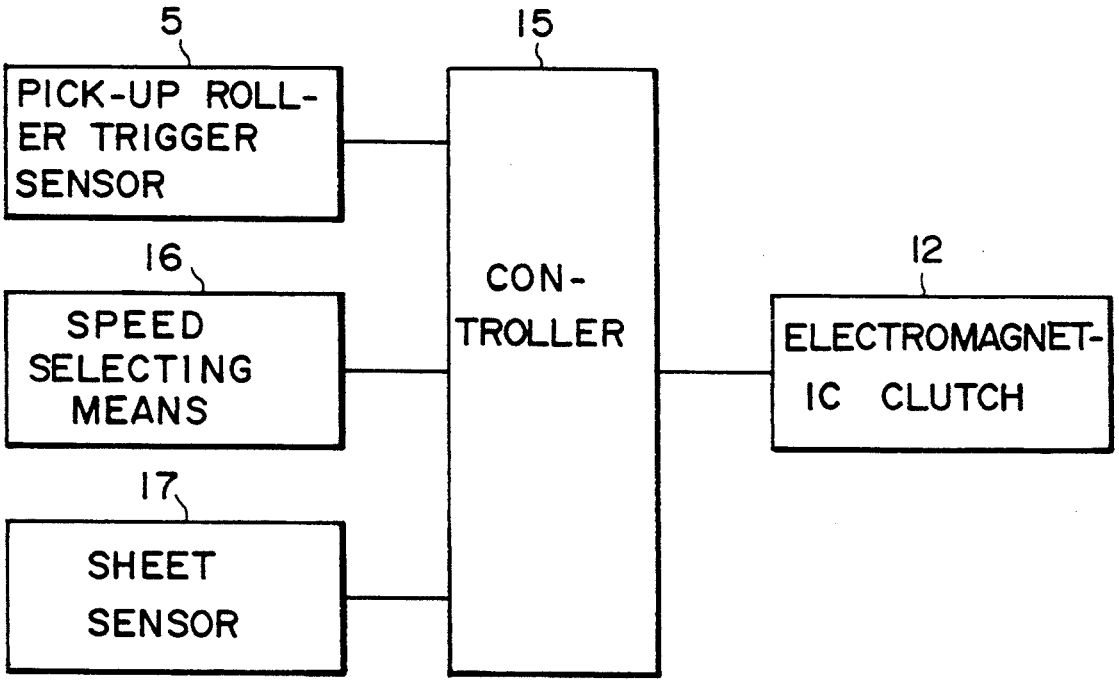
FIG. 4 is a block diagram schematically showing a control system included in the embodiment for controlling the part shown in FIG. 2.
Figure 5:
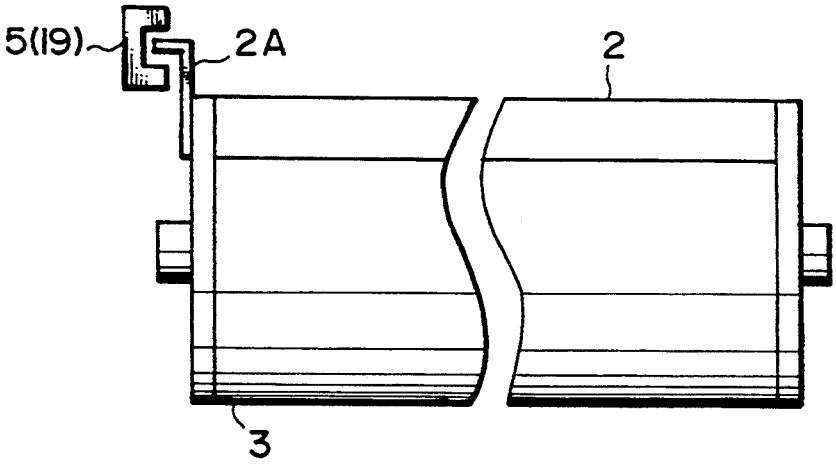
FIG. 5 is a view showing a specific arrangement of a pick-up roller trigger sensor connected to the controller of the embodiment.

The electromagnetic clutch 12 of the sheet feed section 6 is controlled by a controller 15 shown in FIG. 4. The controller 15 is mainly constituted by a microcomputer which executes arithmetic and logical operations for print processing. The pick-up roller trigger sensor 5, speed selecting means 16 and a sheet sensor 17 are connected to the input of the controller 15 via an input/output interface, not shown. The clutch 12 is connected to the output of the controller 15. The pick-up roller trigger sensor 5 is implemented by a photosensor and located in close proximity to the surface of the drum 2. As shown in FIG. 5, when the screen member 2A affixed to the surface of the drum 2 blocks the optical path of the sensor 5, the sensor 5 generates a trigger signal. The trigger signal is used to set up the timing for causing the pick-up roller 6B to start picking up the sheet S.

The speed selecting means 16 is implemented by, for example, numeral keys provided on an operation panel 1A, FIG. 1. The speed selecting means 16 may be operated to change the print speed, i.e., the rotation speed of the motor 4. The sheet sensor 17 precedes the register section 7 in the sheet feed direction A, FIG. 2, and senses the leading edge of the sheet S being driven toward the register section 7 from the sheet feed section 6.

On receiving the signal from the pick-up roller trigger sensor 5, the controller 15 energizes the electromagnetic clutch 12 to transfer the rotation of the drive motor 4 to the pick-up roller 6B. Then, the controller 15 causes the pick-up roller 6B to stop rotating at a particular time in response to a signal from the sheet sensor 17 responsive to the leading edge of a sheet S fed from the rack 6A. In this manner, the controller 15 controls the amount of drive of the pick-up roller 6B. For this purpose, the controller 15 stores delay times each being associated with a particular print speed and defining the time when the clutch 12 should be restored to a deenergized state. Specifically, one of the delay times matching the print speed is selected, and on the elapse of the delay time a signal for deenergizing the clutch 12 is generated. In the illustrative embodiment, the lower the print speed, the longer the delay time is.

Figure 6:
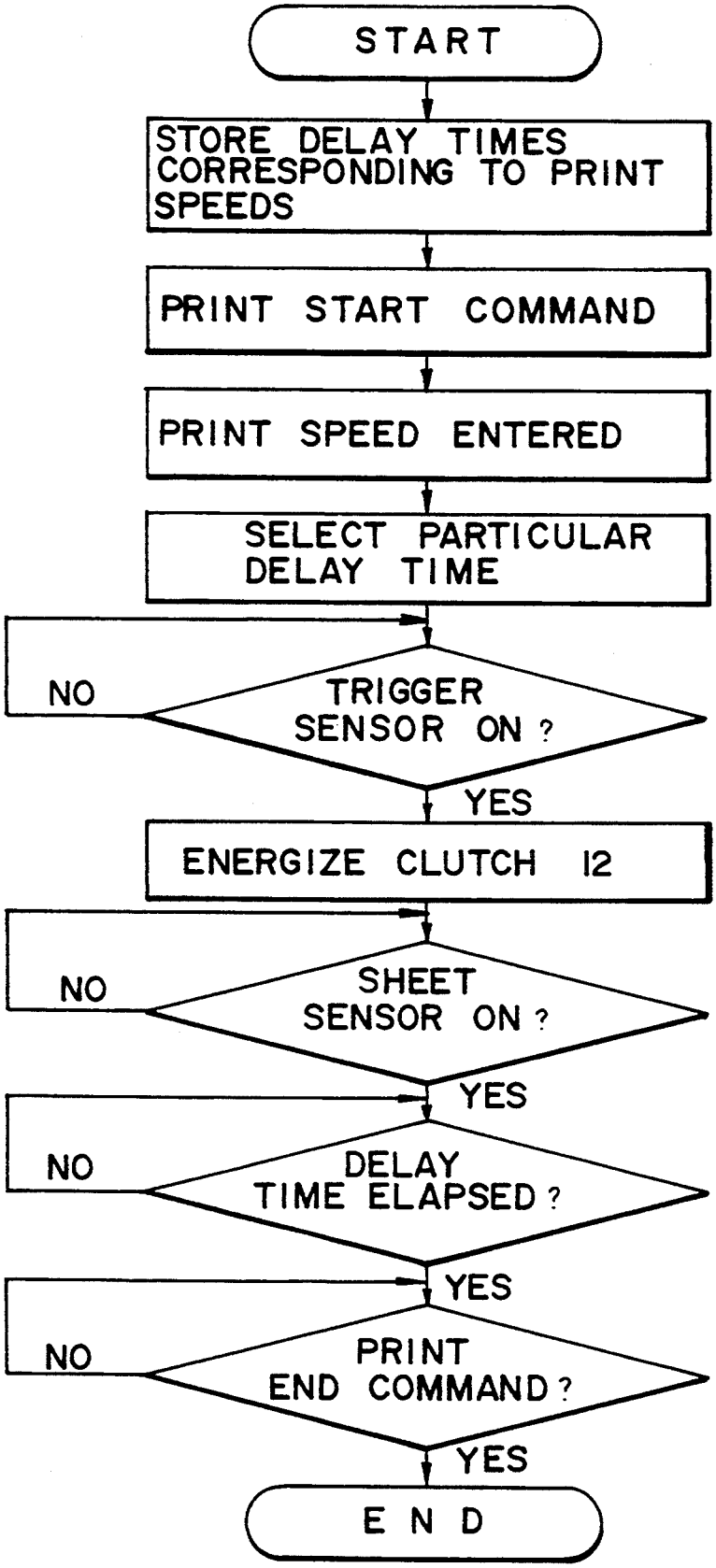
FIG. 6 is a flowchart demonstrating a specific operation of the control system of FIG. 4.

A specific operation of the controller 15 will be described with reference to FIG. 6. On the start-up of the printer 1, the controller 15 stores or registers delay times each defining a particular time when the pick-up roller 6B should stop rotating in matching relation to a print speed, i.e., a particular time when the electromagnetic clutch 12 should be restored from an energized state to a deenergized state. As a print start command is entered on, for example, the operation panel 1A. FIG. 1, the controller 15 selects one of the stored delay times matching a print speed entered on the speed selecting means 16. Then, the controller 15 determines whether or not a signal from the pick-up roller trigger sensor 5 has arrived. When the signal from the sensor 5 arrives, the controller 15 energizes the clutch 12. As a result, the rotation of the drive motor 4 is transmitted to the shaft 6B1 of the pick-up roller 6B via the belt 13, drive gear 14, and driven gear 11. As the pick-up roller 6B feeds the uppermost sheet S from the rack 6A, the controller 15 determines whether or not the sheet sensor 17 has sensed the leading edge of the sheet S. As the sheet sensor 17 senses the leading edge of the sheet S, the controller 15 delays the time for deenergizing the clutch 12 by the above-mentioned delay time from that instant.

In the illustrative embodiment, the delay time increases with the decrease in print speed. Therefore, the sheet S can be paid out in a constant amount although the moving speed of the sheet S changes with the print speed. This maintains the slack of the sheet S to occur after abutment against the register roller pair 7 constant. After the amount of rotation of the pick-up roller 6B has been controlled as stated above, the controller 15 determines whether or not a print end command has been entered. If the answer of this decision is negative, the controller 15 repeats the above processing. Such a procedure is repeated until a print end command arrives.

Figure 7:
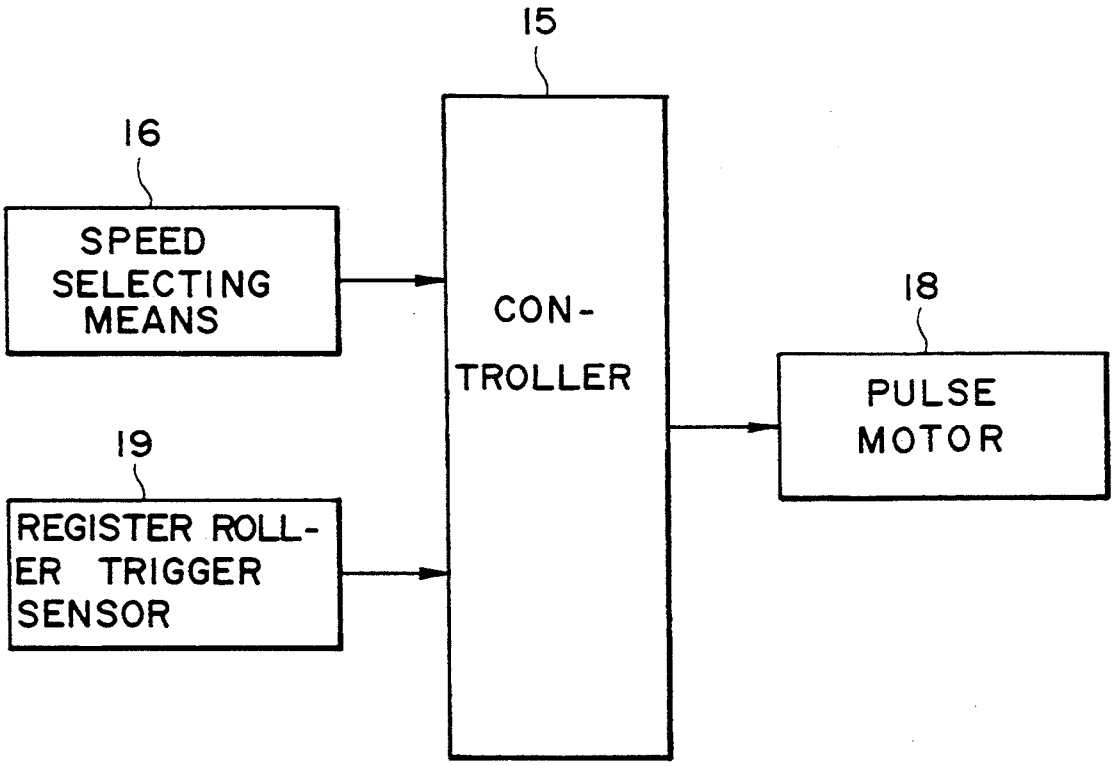
FIG. 7 is a block diagram schematically showing a control system representative of an alternative embodiment of the present invention.

An alternative embodiment of the present invention will be described hereinafter. In this embodiment, the register section 7 is not driven by the drive motor 4 associated with the drum 2, but by an exclusive drive source in terms of the amount of rotation and the time for rotation. Specifically, the embodiment uses a pulse motor 18 (see FIG. 1) for driving the lower register roller 7A under the control of the controller 15. As shown in FIG. 7, a register roller trigger sensor 19 is connected to the input of the controller 15 in place of the pick-up roller trigger sensor 5 and sheet sensor 17, FIG. 4. A driver for driving the pulse motor driver 18 is connected to the output of the controller 15. The register roller 7A is movable into and out of contact with the overlying register roller 7B, as in the previous embodiment. The register roller trigger sensor 19 is implemented as a photosensor located in a different phase from the pick-up roller trigger sensor 5. When the screen member 2A of the drum 2 blocks the optical path of the sensor 19, the sensor 19 generates a trigger signal or feed start signal meant for the register section 7. Before the controller 15 causes the register section 7 to start feeding the sheet S in response to the feed start signal from the sensor 19, it sets a delay time for delaying the time when the register section 7 should start feeding the sheet S in matching relation to the print speed. Specifically, the controller 15 delays the time for starting driving the pulse motor 18 so as to bring the sheet S into register with the master 3 wrapped around the drum 2. Assuming that the feed speed of the is register section 7 is constant, the delay time is selected such that the time for causing the register section 7 to feed the sheet S advances as the print speed increases.

Figure 8:
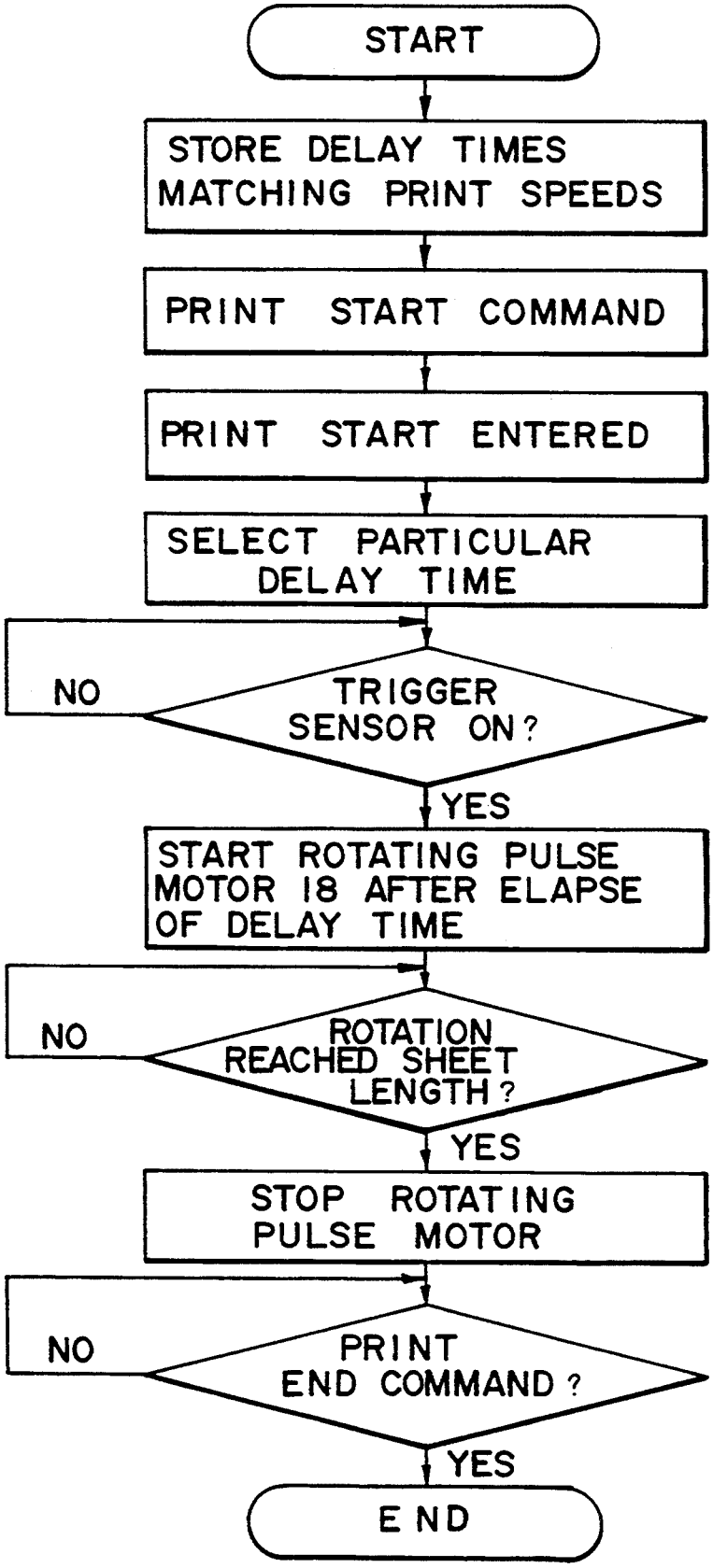
FIG. 8 is a flowchart representative of a specific operation of the control system of FIG. 7.

A reference will be made to FIG. 8 for describing a specific operation of the controller 15 in the above embodiment. On the start-up of the printer 1, the controller 15 stores or registers delay times each defining a particular time for causing the register section 7 to start feeding the sheet S, i.e., the time for starting rotating the pulse motor 18. As a print start command is entered on, for example, the operation panel 1A. FIG. 1, the controller 15 selects one of the stored delay times matching a print speed entered on the speed selecting means 16. Then, the controller 15 determines whether or not a signal from the register roller trigger sensor 19 has arrived. On receiving a signal from the register roller trigger sensor 19, the controller 15 starts driving the pulse motor 18 when the delay time selected elapses. As a result, the register section 7 starts feeding the sheet S abutting against the sheet S toward a position where the pressing section or roller 8 and the drum 2 contact each other. The amount of rotation of the pulse motor 18 is selected on the basis of the size of the sheet S such that the register section 7 continuously feeds the sheet S until the trailing edge of the sheet S moves away from the section 7. On reaching such an amount of rotation, the pulse motor 18 is deenergized.

Figure 9:
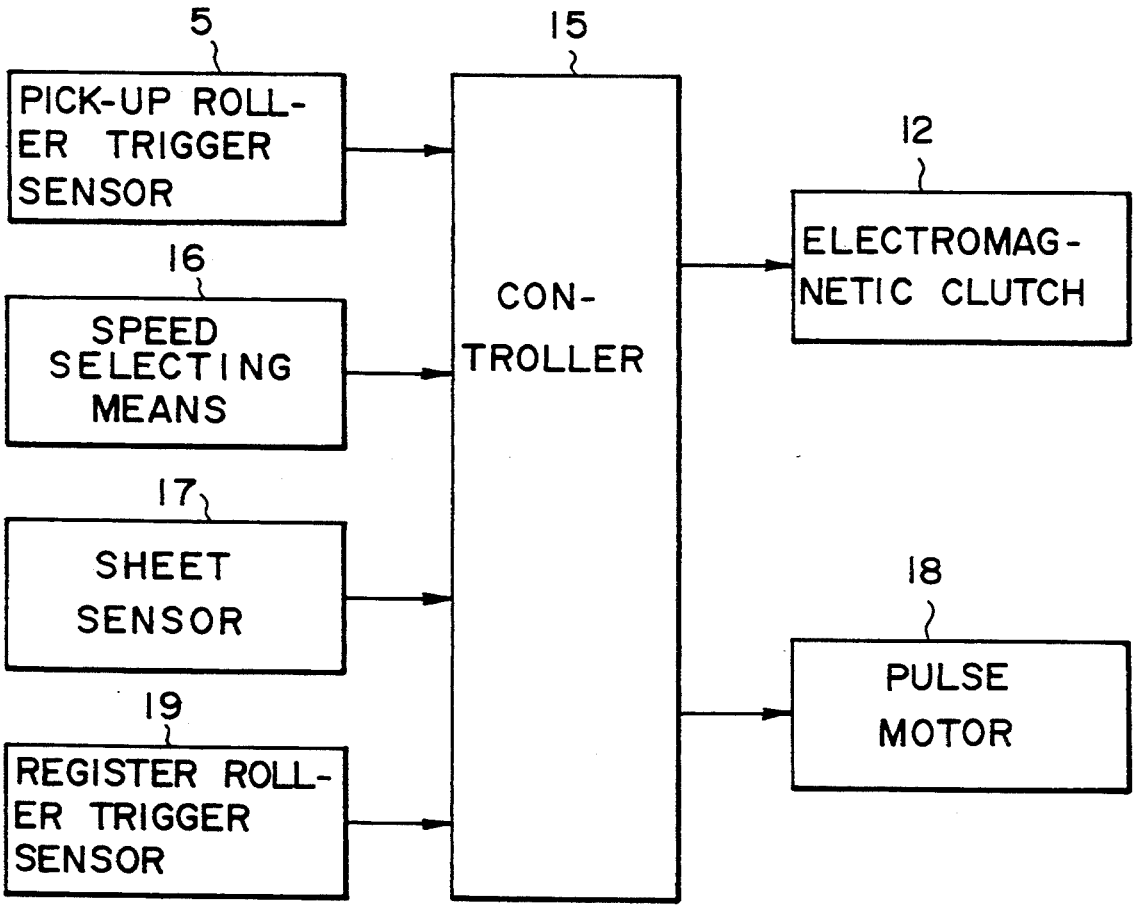
FIG. 9 is a block diagram schematically showing a system representative of another alternative embodiment of the present invention.

Another embodiment of the present invention will be described in which the controller 15 controls both of the pick-up roller 6B and lower register roller 7A shown in FIG. 2. In this embodiment. the electromagnetic clutch 12, FIGS. 2 and 3, and the pulse motor 18, FIG. 1, are used to drive the pick-up roller 6B and the lower register roller 7A, respectively. As shown in FIG. 9, the pick-up roller trigger sensor 5, speed selecting means 16, sheet sensor 17 and register roller trigger sensor 19 are connected to the input of the controller 15. Drivers for driving the electromagnetic clutch 12 and pulse motor 18 are connected to the output of the controller 15. The controller 15 energizes the electromagnetic clutch 12 in response to a signal from the pick-up roller trigger sensor 5 and then starts rotating the pulse motor 18 in response to a signal from the register roller trigger sensor 19. Before executing this step, the controller 15 determines a delay time matching the print speed for each of the clutch and pulse motor 18, i.e., a delay time for delaying the deenergization of the clutch 12 and a delay time for delaying the start of drive of the motor 18.

Figure 10:
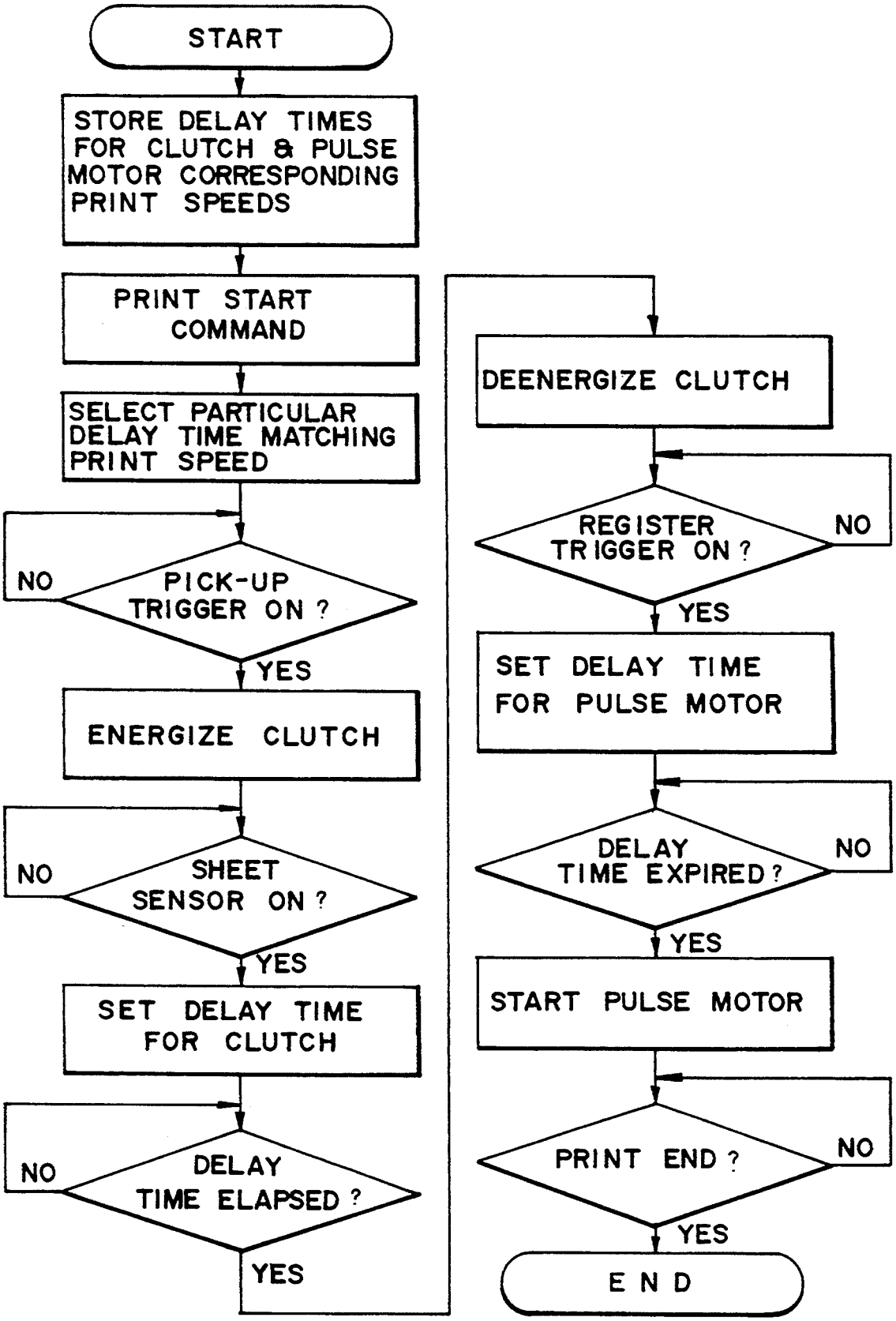
FIG. 10 is a flowchart representative of a specific operation of the control system of FIG. 9.

A reference will be made to FIG. 10 for describing a specific operation of the controller 15 in the above embodiment. On the start-up of the printer 1, the controller 15 stores or registers delay times each defining a particular time when the pick-up roller 6B should stop rotating in matching relation to a print speed, i.e., a particular time when the electromagnetic clutch 12 should be restored from an energized state to a deenergized state. As a print start command is entered on, for example, the operation panel 1A, FIG. 1, the controller 15 selects one of the registered delay times which matches information entered on the speed selecting means 16. Then, the controller 15 determines whether or not a signal from the pick-up roller trigger sensor 5 has arrived. When the signal from the sensor 5 arrives, the controller 15 energizes the clutch 12. As a result, the rotation of the drive motor 4 is transmitted to the shaft 6B1 of the pick-up roller 6B via the belt 13, drive gear 14, and driven gear 11. As the pick-up roller 6B feeds the uppermost sheet S from the rack 6A, the controller 15 determines whether or not the sheet sensor 17 has sensed the leading edge of the sheet S. As the sheet sensor 17 senses the leading edge of the sheet S, the controller 15 delays the time for deenergizing the clutch 12 by the above-mentioned delay time from that instant.

Also, the controller 15 selects one of the stored delay times meant for the pulse motor 18 and matching a print speed entered on the speed selecting means 16. Then, the controller 15 determines whether or not a signal from the register roller trigger sensor 19 has arrived. On receiving a signal from the register roller trigger sensor 19, the controller 15 starts driving the pulse motor 18 when the delay time selected elapses. As a result, the register section 7 starts feeding the sheet S abutting against the sheet S toward a position where the pressing section or roller 8 and the drum 2 contact each other. The amount of rotation of the pulse motor 18 is selected on the basis of the size of the sheet S such that the register section 7 continuously feeds the sheet S until the trailing edge of the sheet S moves away from the section 7. On reaching such an amount of rotation, the pulse motor 18 is deenergized. On completing the control over the rotation of the pulse motor 18, the controller 15 determines whether or not a print end command has been entered. The controller 15 repeats the above procedure until a print end command arrives.

In this embodiment, the pick-up roller trigger sensor 5 and register roller trigger sensor 19 may be implemented by a single sensor. In such a case, on receiving a signal from, for example, the pick-up roller trigger sensor 5, the controller 15 will cause the register roller 7A to contact the register roller 7B, set a longer delay time for delaying the start of drive of the pulse motor 18 than in the above-stated case, and then execute the processing described above.

Figure 11:
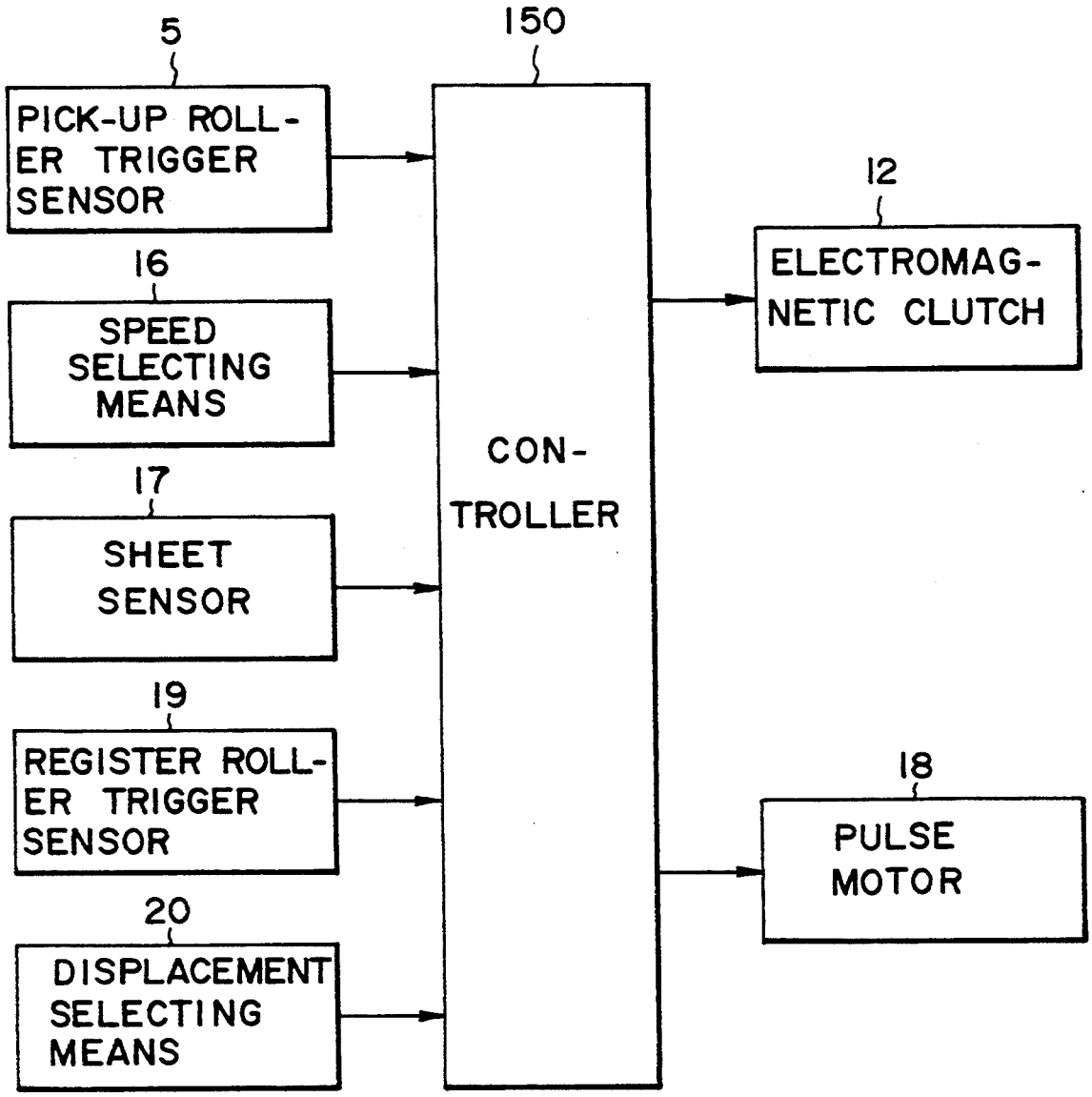
FIG. 11 is a schematic block diagram showing a control system representative of another alternative embodiment of the present invention.

Hereinafter will be described another alternative embodiment of the present invention in which the timing for starting feeding the sheet S from the register section 7 is used to change the position to start transferring an image on the sheet S. It is often desired to change the size of the blank area or margin at the leading edge of the sheet S with respect to the sheet feed direction in matching relation to the configuration of a printing. In this embodiment, when the operator enters a particular size in the top-and-bottom direction which corresponds to the margin of interest, a controller 150. FIG. 11, sets up a displacement of the sheet S required to implement such a size in terms of the time for causing the register section 7 to start driving the sheet S. FIG. 11 shows a control arrangement for setting up the displacement of the sheet S. The controller 150, like the controller of FIG. 4, is mainly constituted by a microcomputer.

Assume that the embodiment controls the rotation of the pick-up roller 6 of the sheet feed section 6 via the electromagnetic clutch 12, as in the arrangement of FIG. 2. Then, as shown in FIG. 11, the pick-up roller trigger sensor 5, speed selecting means 16, sheet sensor 17, register roller trigger sensor 19 and displacement selecting means 20 are connected to the input of the controller 150. Connected to the output of the controller 150 are the electromagnetic clutch 12 and the driver for the pulse motor 18. The controller 150 stores a table listing print speeds and corresponding delay times meant for the clutch 12, as stated earlier. In addition, the controller 150 stores a table listing delay times for changing the time for starting driving the pulse motor 18 in response to a signal from the register roller sensor 19 on the basis of information entered on the displacement selecting means 20 and print speed. By selecting a particular delay time out of this table, the controller 150 determines the time for actually starting driving the pulse motor 18. FIG. 12 shows a specific table showing print speeds (a<b<c<d) and corresponding displacements of the sheet S, on the assumption that the displacement is variable on a 1 millimeter basis.

Figure 13:
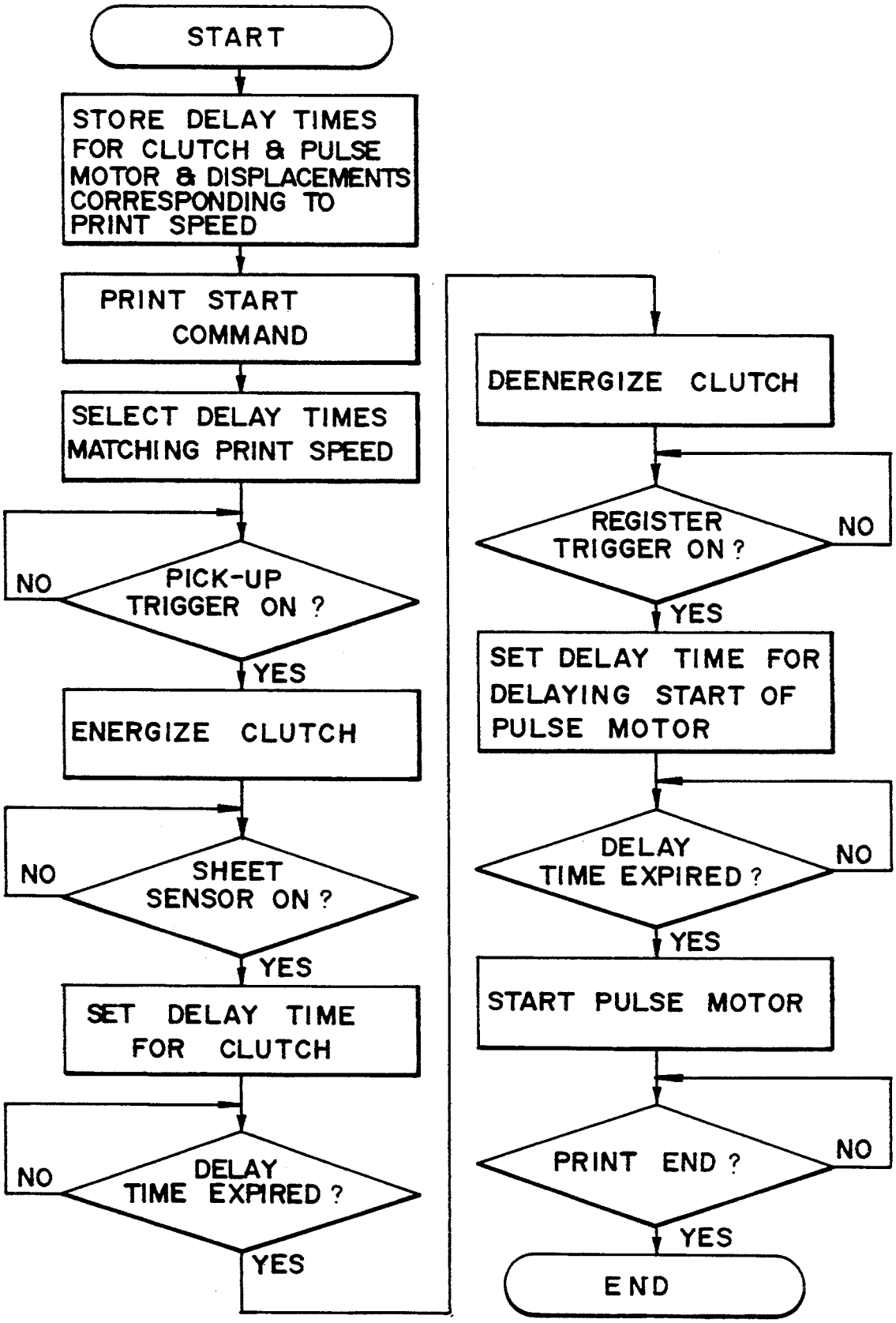
FIG. 13 is a flowchart representative of a specific operation of the control system of FIG. 11.

A specific operation of the controller 150 will be described with reference to FIG. 13. As shown, on the start-up of the printer 1, the controller 150 stores or registers delay times each defining a particular time when the pick-up roller 6B should stop rotating in matching relation to a print speed, i.e., a particular time when the electromagnetic clutch 12 should be restored to an energized state to a deenergized state. At the same time. the controller 150 stores delay times each being associated with a particular time for starting driving the register section 7 in relation to a displacement. As a print start command is entered on, for example, the operation panel 1A, FIG. 1, the controller 15 selects one of the registered delay times matching information entered on the speed selecting means 16. Then, the controller 15 determines whether or not a signal from the pick-up roller trigger sensor 5 has arrived. When the signal from the sensor 5 arrives. the controller 15 energizes the clutch 12. As a result, the rotation of the drive motor 4 is transmitted to the shaft 6B1 of the pick-up roller 6B via the belt 13, drive gear 14, and driven gear 11. As the pick-up roller 6B feeds the uppermost sheet S from the rack 6A, the controller 15 determines whether or not the sheet sensor 17 has sensed the leading edge of the sheet S. As the sheet sensor 17 senses the leading edge of the sheet S, the controller 15 delays the time for aleenergizing the clutch 12 by the above-mentioned delay time from that instant. Also, the controller 15 selects a particular delay time for delaying the time for starting feeding the sheet S from the register section 7 and matching the determined displacement of the sheet S and print speed. On the elapse of this delay time, the controller 15 brings the register roller 7A into contact with the register roller 7B and then rotates it. At this instant, the sheet S is held in abutment against the register section 7 and provided with a slack determined by the time for stopping the rotation of the pick-up roller 6B. The slack of the sheet S remains the same at any print speed, as stated earlier. The register section 7 starts driving such a sheet S on the elapse of the above-mentioned delay time to change the position of the sheet S relative to the position of the master 3. As a result, the sheet S is provided with a desired margin at the leading edge thereof.

Figure 14:
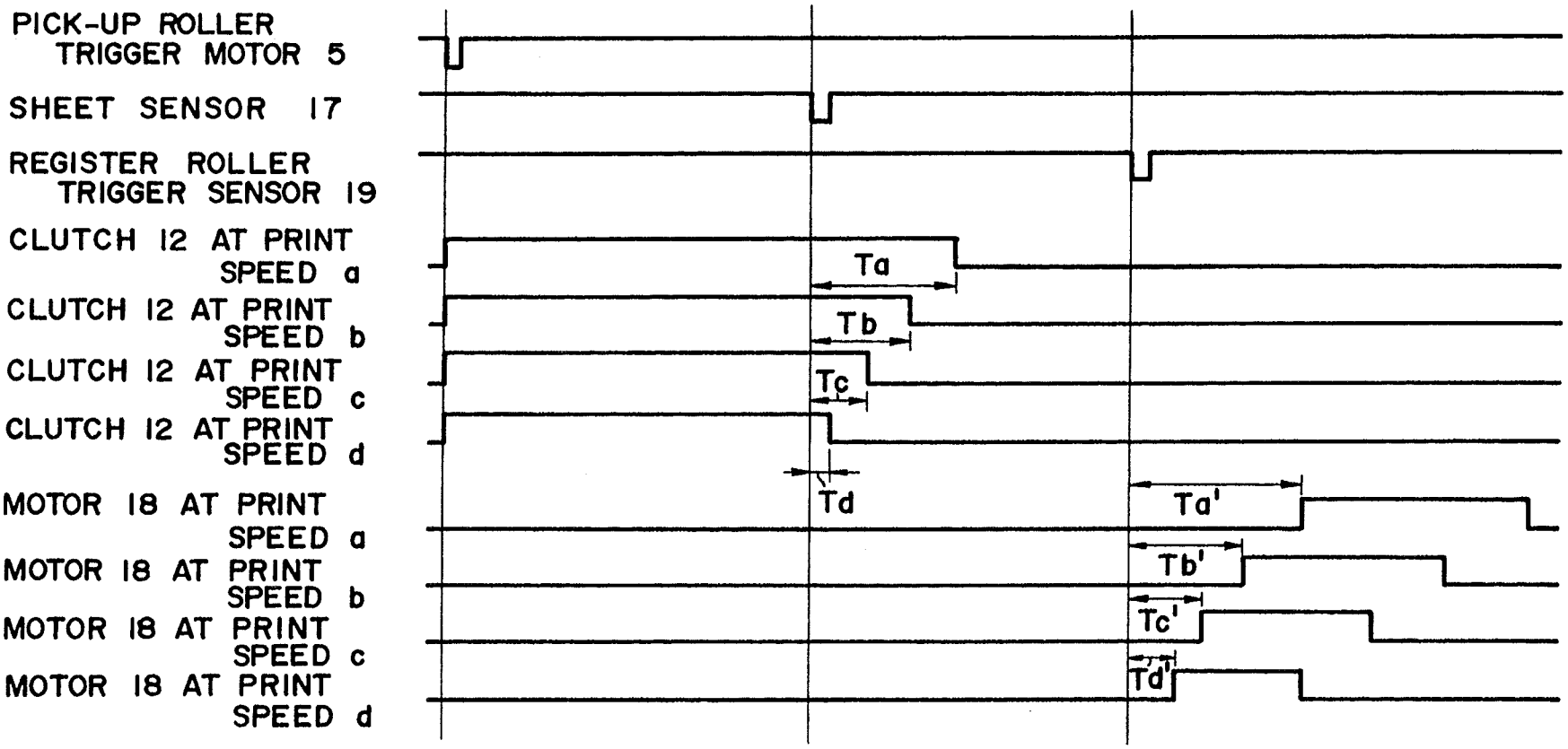
FIG. 14 is a timing chart associated with the embodiment of FIG. 11.

FIG. 14 is a timing chart representative of a specific relation between delay times (Ta, Tb, Tc and Td) associated with the end of rotation of the pick-up roller 6B and delay times (T'a, T'b, T'c and T'd) associated with the feed start at the register section 7. In FIG. 14, the delay times meant for the register section 7 correspond to the delay times shown in FIG. 11.

Figure 15A:
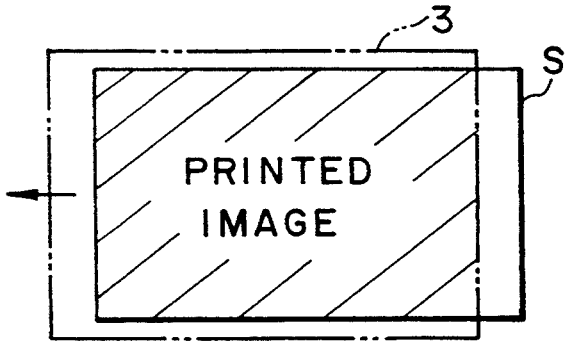
FIGS. 15A. 16A and 17A are plan views each showing a particular relation between the image position of a master and the image transfer position of a sheet set up by the control system of FIG. 11.
Figure 15B:
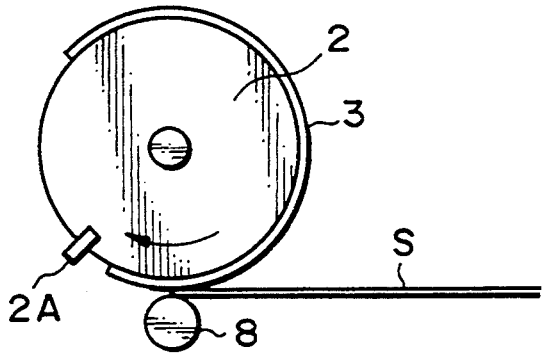
FIGS. 15B, 16B and 17B are side elevations each showing a particular relation between the leading edge of a sheet being fed toward the master and the leading edge of an image of the master.
Figure 16A:
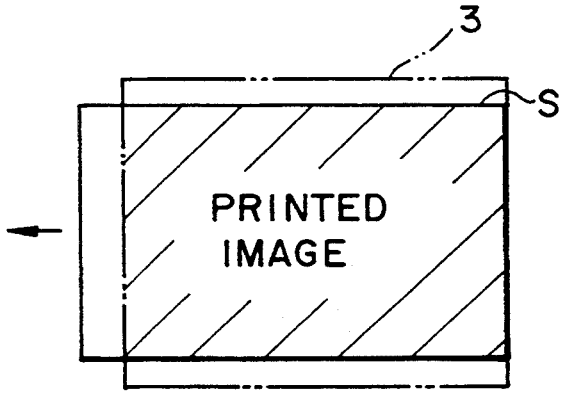
Figure 16B:
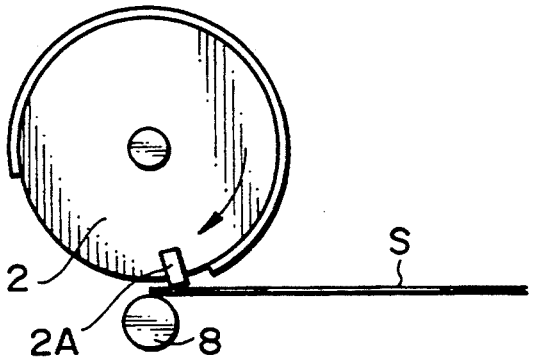
Figure 17A:
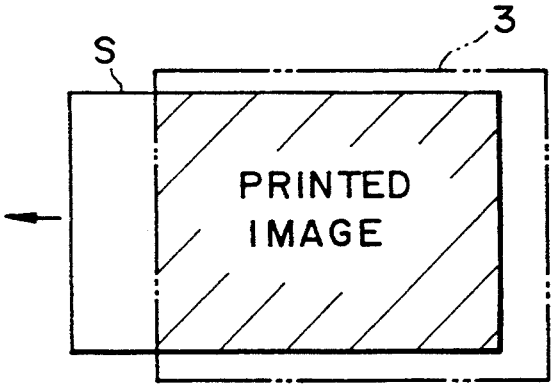
Figure 17B:
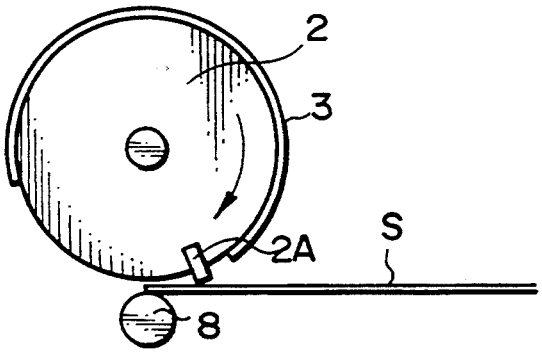

As stated above, by delaying the time for causing the register section 7 to start driving the sheet S, it is possible to change the position on the sheet S where the image of the master 3 begins to be transferred. FIGS. 15A, 16A and 17A each shows the master 3 and sheet S in a particular transfer start position while FIGS. 15B, 16B and 17B each shows the leading edge of the sheet S and the leading edge of the image of the master 3 in a particular position. In these figures, the delay time is sequentially increased in the incrementing order of figure numbers. Specifically, the margin at the leading edge of the sheet S (displacement in the top-and-bottom direction) is sequentially increased with the increase in the delay time.

In summary, it will be seen that the present invention provides a sheet feed device in which a sheet feed section and a register section can each be controllably driven by exclusive means. The device, therefore, simplifies drive transmission mechanisms for the sheet feed section and register section. This prevents the amount of sheet feed from becoming unstable due to the wear and fatigue of mechanical parts and prevents a sheet from being brought out of register with an image at an image forming station. Even when the displacement of a sheet is changed to change the position on a sheet where an image begins to be transferred, it is possible to control the sheet feed start timing by the register section which is subjected to exclusive drive control. Hence, any desired displacement of a sheet in the top-and-bottom direction can be set by a simple arrangement.

Various modifications will become possible for those skilled in the art after receiving the teachings of the present disclosure without departing from the scope thereof. For example, while the present invention has been shown and described in relation to the ink drum of a printer, it is, of course, practicable with a photoconductive element incorporated in an electrophotographic copier or printer.

What is claimed is:

1. A sheet feed device for image forming equipment and having a rack on which sheets are stacked, pick-up means for feeding uppermost one of said sheets from said rack while separating the one sheet from the other sheets, and register means located upstream of an image forming section with respect to an intended direction of sheet feed, said device feeding the sheet toward said register means in response to a feed start signal from said image forming section, said device comprising:

sheet sensing means for sensing the sheet being fed from the rack toward the register means;

speed selecting means for entering a period of time necessary for an image to be formed at the image forming section, wherein said pick-up means comprises a driver; and control means connected at an input to said sheet sensing means and said speed selecting means and at an output to said driver included in the pick-up means for controlling, on receiving a signal from said sheet sensing means, an amount of drive of said pick-up means in matching relation to the period of time entered on said speed selecting means, said control means comprising means for storing a plurality of delay times which are each associated with a selected period of time entered on said speed selecting means, wherein said driver included in said pick-up means is de-energized at an end of an associated delay time.

2. A device as claimed in claim 1, further comprising:

a pick-up roller trigger means located adjacent to a surface of a drum of said image forming section for providing the feed start signal to the pick-up means to cause the pick-means to start picking up the uppermost one of said sheets.

* * * * *